United States Patent [19]

Greenwood

[11] 3,999,685

[45] Dec. 28, 1976

[54] REMOTE CONTROL CONSOLE FOR A PLURALITY OF AUTOMATIC GASOLINE DISPENSERS

[75] Inventor: Robert C. Greenwood, Cypress, Calif.

[73] Assignee: Pan-Nova, Inc., Santa Fe Springs, Calif.

[22] Filed: May 29, 1975

[21] Appl. No.: 581,809

[52] U.S. Cl. ..... 222/16; 194/13; 235/92 FL

[51] Int. Cl.[2] ..... B67D 5/26; B67D 5/30; G07F 13/00

[58] Field of Search ..... 222/2, 14–22, 222/32–35; 194/13; 235/92 FL

[56] References Cited

UNITED STATES PATENTS

| | | | |
|---|---|---|---|
| 3,498,501 | 3/1970 | Robbins et al. | 222/35 X |
| 3,771,697 | 11/1973 | Sasnett | 222/16 |
| 3,786,960 | 1/1974 | Young | 222/2 |
| 3,878,377 | 4/1975 | Brunone | 235/92 FL X |

*Primary Examiner*—Robert B. Reeves
*Assistant Examiner*—Francis J. Bartuska
*Attorney, Agent, or Firm*—Harris, Kern, Wallen & Tinsley

[57] ABSTRACT

A control unit and dispensers for a gasoline station providing for prepayment at a single control of fuel dispensing at each of a plurality of dispensers, and automatic payout of change whenever a customer does not take all of the gasoline paid for. A control unit for introducing credits into a selected dispenser and removing credits from the dispenser (i.e., debiting the selected dispenser), and recording credits and debits.

9 Claims, 14 Drawing Figures

REMOTE CONTROL CONSOLE FOR A PLURALITY OF AUTOMATIC GASOLINE DISPENSERS

BACKGROUND OF THE INVENTION

Automatic dispensers are being designed and used at gasoline stations and several such units are shown in U.S. Pat. Nos. 3,550,743; 3,605,973; 3,666,928; 3,731,777; 3,768,617; and 3,786,960. In these dispensers, a quantity of fuel is purchased by the customer, in terms of dollars or gallons or other units, and this purchase is registered in the dispenser, mechanically as by deposit of tokens or coins, or electrically as by a switch setting or electrical pulses. Typically the customer purchases tokens from an attendant and deposits them in the dispenser or pays the attendant and the attendant sets the register in the dispenser.

The customer then positions the hose nozzle in the fuel tank of the vehicle and opens the valve to start gasoline flow. When all of the fuel paid for is dispensed, the dispenser automatically shuts off gasoline flow. If for any reason the customer does not wish to take all the fuel paid for, the customer may shut off flow and return the hose nozzle to the dispenser. Change will automatically be paid to the customer for the value of the fuel paid for but not received.

Present day gasoline stations utilize a plurality of dispensers, typically 12, and it is desirable to be able to operate the 12 dispensers with a single attendant. In one mode of operation, the attendant runs from dispenser to dispenser as the customers drive in. This has not been satisfactory because one attendant cannot handle a busy location. In another mode of operation, customers pull up to the dispensers, take whatever amount of gasoline they desire, and then make payment to an attendant located at a control booth at the exit of the station, with the amount of fuel and the cost of the fuel being metered at the booth. This system has not been satisfactory in all respects, as it requires meter reading and change making by the attendant, a time consuming operation at a busy installation, and also has the problem of customers taking more fuel than they are prepared to pay for. Another form of remote operation utilizing non-change making dispensers is shown in U.S. Pat. No. 3,402,851. A more pertinent system with remote console and a plurality of change making dispensers is shown in the copending application Ser. No. 469,518, filed May 13, 1974 now U.S. Pat. No. 3,921,854 and assigned to the same assignee as the present application.

The system of the aforesaid copending application provides a bank of push button switches for selecting a dispenser and another bank of push button switches for selecting an amount to be dispensed. After the customer indicates the dispenser and amount and makes payment, the attendant actuates the console and enters the credits into the selected dispenser. If the customer changes his mind, or has made an error in stating the dispenser or amount, or if the attendant has made an incorrect entry, the selected dispenser can be reset. However the attendant has to make a manually written record of this change and this gives rise to problems in the record keeping.

It is an object of the present invention to provide a new and improved control unit for operation with a plurality of dispensers at a gasoline station providing for prepayment by the customer, control of the operation by a single attendant, automatic change payout to each customer when the amount of fuel paid for has not been taken, and the ability to remove credits from a selected dispenser (i.e., debit a dispenser) and automatically maintain a record of credits and debits. The invention will be described herein in conjunction with the dispenser of U.S. Pat. No. 3,605,973, but it will be readily understood that the invention is equally suitable for use with other change making dispensers. Also, while the invention is described as used with gasoline, it is equally suitable for dispensing of other fluid.

SUMMARY OF THE INVENTION

A plurality of automatic change paying fluid dispensers are operated from a single control console. The attendant at the control console receives advance payment for a number of sales units, typically in dollars or gallons, selects a dispenser by actuating a selection switch, and enters the prepaid number of sales units by actuating a value switch. Sales units are entered into the selected dispenser by electric pulses from a pulse generating circuit at the control console. After the credits are entered into the selected dispenser, the dispenser is ready for operation by the customer, and the control console is available for entering sales unit credit into another selected dispenser. At any time prior to start of fluid flow, the attendant may debit the selected dispenser, automatically recording the debits as well as credits.

The control console includes means for selecting a dispenser, means for generating the input signal for connection to the dispenser, means for resetting a dispenser to the initial position in the case of a malfunction or change of mind and debiting the credits removed in resetting, and means for indicating to the attendant when a dispenser is available for selection and use by a customer.

DESCRIPTION OF THE PREFERRED EMBODIMENT

The Dispenser

FIGS. 1–9 illustrate one modification of the dispenser of U.S. Pat. No. 3,605,973 for use in the present invention. Of course neither this particular dispenser nor the specific modification disclosed is essential. Other dispensers, such as Keene Model 512 REW and A. O. Smith Model E-501, may be used. Also, since payment is being made at the control console, the coin or token receiving components, such as the coin acceptor unit 32, the coin chutes 34, the coin slots 34' and the switch 33, may be omitted. Also the contact sets CS and 1.00AR adjacent the 1.00AR relay may be omitted. The control console of FIGS. 11 and 12 serves as an alternate method of adding credits to a dispenser and ordinarily is not used simultaneously with tokens.

Figure 1:
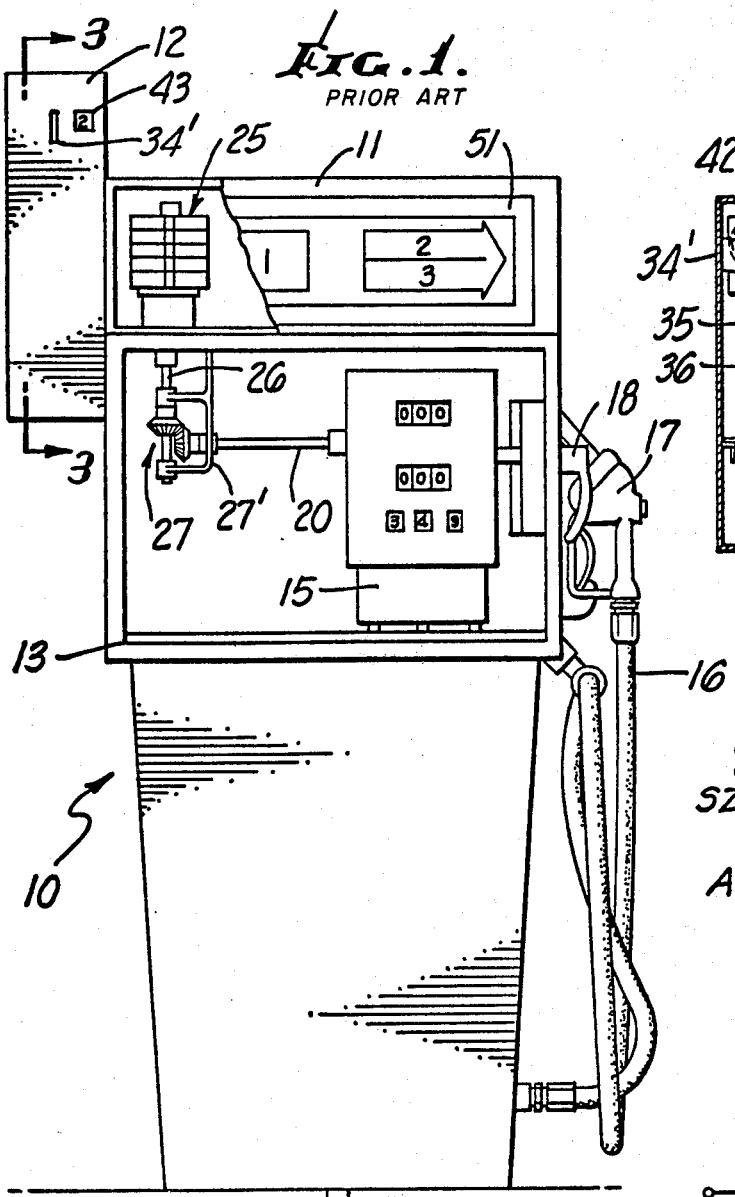
FIG. 1. PRIOR ART
FIG. 1 is a side view of an automatic change-paying gasoline dispenser, with portions of the side panels of the housing removed.
Figure 2:
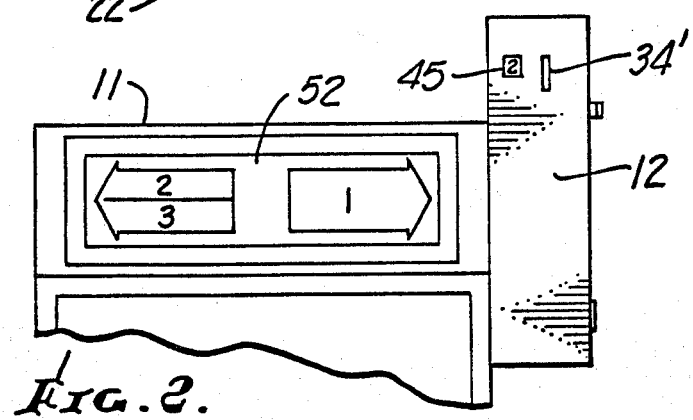
FIG. 2. PRIOR ART
FIG. 2 is a partial view of the dispenser of FIG. 1 from the opposite side.

The structure of FIG. 1 includes a gasoline delivery unit 10 (Tokheim Model 1150T-S-RC-APC) to which the coin-operated dispensing system has been attached, with the system contained in housings 11, 12. A side panel has been removed from the housing 13 of the gasoline delivery unit 10 to show some of the interior connections. The delivery unit 10 includes an inlet pipeline 14, a flow meter or computer 15, hose 16 and outlet nozzle 17, and a lever 18 for operating switches designated as pump control switch No. 1 and No. 2, PCS-1 and PCS-2. The flow meter 15 provides for measuring the amount of gasoline flowing from the nozzle 17 and indicates the measured amount in gallons and in dollars and cents. A dispenser reset motor DRM is incorporated in the flow meter 15 for resetting the mechanism to the zero condition. A shaft 20 projects from the side of the flow meter 15 and makes one complete revolution for each 10-cent increment of fluid dispensed. Two valves are connected in parallel between the inlet pipeline 14 and the hose 16 for controlling fluid flow from the pump to the outlet nozzle, with the valves being controlled by valve solenoids No. 1 and No. 2, V1 and V2. When both valves are closed, there is no flow; when both valves are opened, there is fluid flow at the maximum or full rate; when one valve is open and one valve is closed, there is flow at an intermediate or slow flow rate. In a typical installation, the two valves will be of equal size so that the slow flow rate is one-half the full flow rate. There is a pump 22 in the inlet pipeline 14, with the pump usually being positioned remote from the delivery unit. The pump motor PM is energized in the conventional manner via PCS-2. Each delivery unit may have its own pump motor, or one pump motor may serve several delivery units. The electrial circuitry is shown in FIG. 4 and will be discussed below.

A resolution unit 25 is mounted in the housing 11 and has one input shaft 26 connected to the flow meter shaft 20 by a right angle gear drive 27 supported on a bracket 27'. The resolution unit 25 is illustrated in FIGS. 5–9 includes a differential type arrangement of gears with inputs 26, 28 and an output 29. An electric motor 31 (MRU) has its output shaft connected to the input shaft 28 by flexible coupling 30. In the particular embodiment illustrated, the gear ratios are selected such that 2½ revolutions of the 10 cent shaft 20 from the flow meter produces one revolution of the output shaft 29. The gearing is also arranged so that the motor MRU drives the output shaft 29 in the same direction as the output shaft is driven by the flow meter.

Four cams A, B, C and D (FIGS. 6–9) are mounted on the output shaft 29 for actuating the subtract and zero position switch SZC, the slow flow switch SFC, the nickel pay-out switch NPC, and the penny pay-out switch PPC, respectively, as the shaft 29 rotates. As can be seen from the cam configurations in FIGS. 6–9, cam A activates switch SZC once for each complete revolution, cam B activates switch SFC once per revolution with the opening of SFC preceding the opening of SZC bby approximately 145°. Cam C activates switch NPC at one-fifth, two-fifths, three-fifths and four-fifths of a revolution. Cam D activates switch PPC 20 times per revolution, with the switch being closed every 14.4° of a revolution except at the points when switch NPC is closed and at the zero point. With the particular embodiment illustrated, one revolution of the shaft 29 corresponds to one delivery unit of gasoline having a value of 25 cents. Cam A provides a zero position indicating the start and end of a delivery unit. Cam B is utilized to initiate the slow flow operation by closing one of the valves approximately midway through a delivery unit. Cam C provides signals corresponding to 5 cents, 10 cents, 15 cents and 20 cents, while cam D provides signals for the odd cents between the 5-cent signals of cam C. Of course, other cam configurations can be utilized for other values for delivery units and for other monetary values.

Figure 3:
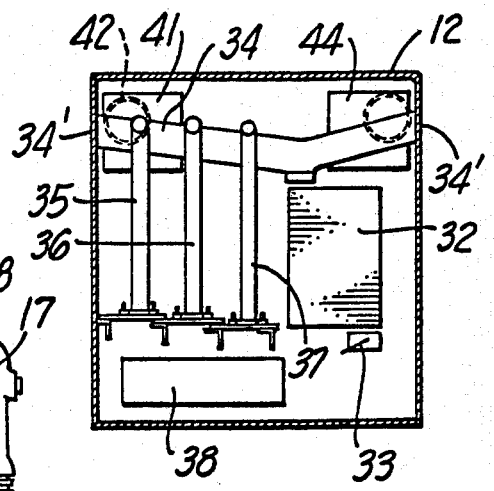
FIG. 3. PRIOR ART
FIG. 3 is a partial sectional view taken along the line 3—3 of FIG. 1 illustrating the money handling portion of the dispenser.
Figure 6:
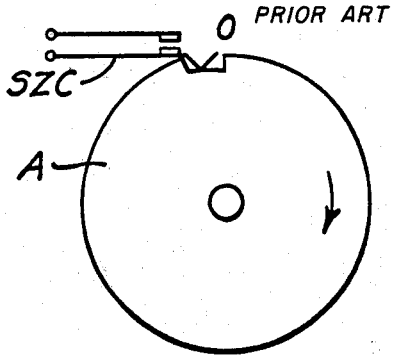
FIG. 6. PRIOR ART
FIGS. 6, 7, 8 and 9 illustrate cams A, B, C and D, respectively, of the resolution unit of FIG. 5.
Figure 7:
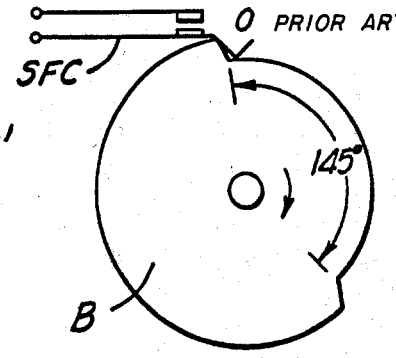
FIG. 7. PRIOR ART

The coin handling units are mounted in the housing 12 and are shown in FIG. 3. A conventional coin acceptance unit 32 is fed by coin chutes 34 leading from coin slots 34' located on opposite sides of the housing 12. The coin acceptance unit 32 functions in the conventional manner to close a coin switch 33 (CS) when a valid coin has been received. The acceptance unit 32 also includes a coin reject solenoid COR for rejecting undesired. coins. A coin count switch CCS is positioned elsewhere in the system to energize the coin reject solenoid when more than a predetermined number of coins are deposited at one time.

The particular embodiment illustrated and described in this application is designed for operation with tokens representing one dollar in value. Of course the system can be designed to handle any type of coin or token and the word coin is used here to include any of the objects representing monetary value.

A coin refund unit is also mounted in the housing 12 and includes quarter, nickel, and penny storage tubes 35, 36, 37, respectively. The quarter tube 35 includes a mechanism for dropping quarters one at a time into pay-out receptacle 38, operated by the quarter pay-out solenoid QPS, and also includes a switch QTE operated when the quarter tube is empty. The nickel tube 36 and the penny tube 37 are similarly equipped with a nickel pay-out solenoid NPS and the tube empty switch NTE and a penny pay-out solenoid PPS and tube empty switch PTE, respectively.

A monetary display unit 41 is mounted in the housing 12 and includes a wheel 42 having the numerals 0 through 9 positioned around the periphery thereof. The wheel is disposed within the housing so that one of the numerals may be viewed through an opening 43 in the housing 12 (FIG. 1). The display unit is stepped through the ten positions by a monetary display solenoid, MDS-1. A similar display unit 44 is positioned in the housing 12 for displaying numerals at a window 45 (FIG. 2) and is operated by another solenoid MDS-2. The units 41, 44 display the number of one-dollar tokens which a customer deposits and are reset to zero when the system is reset. The units typically are solenoid-operated stepper devices of conventional design and it will be recognized that other numerical display devices can be utilized where desired.

Display panels 51, 52 are mounted on opposite sides of the housing 11 and each is provided with three legends identified by numerals 1, 2 and 3, and with lamps for selectively illuminating the legends. The preferred language for each of the legends is set out in Table II. Legend 1 may be presented in the form of an arrow pointing toward coin slots 32. Legends 2 and 3 may be provided in the form of an arrow pointing toward the nozzle 17 and the lever 18. Typically the lever 18 is painted red for ease in location..

Figure 4A:
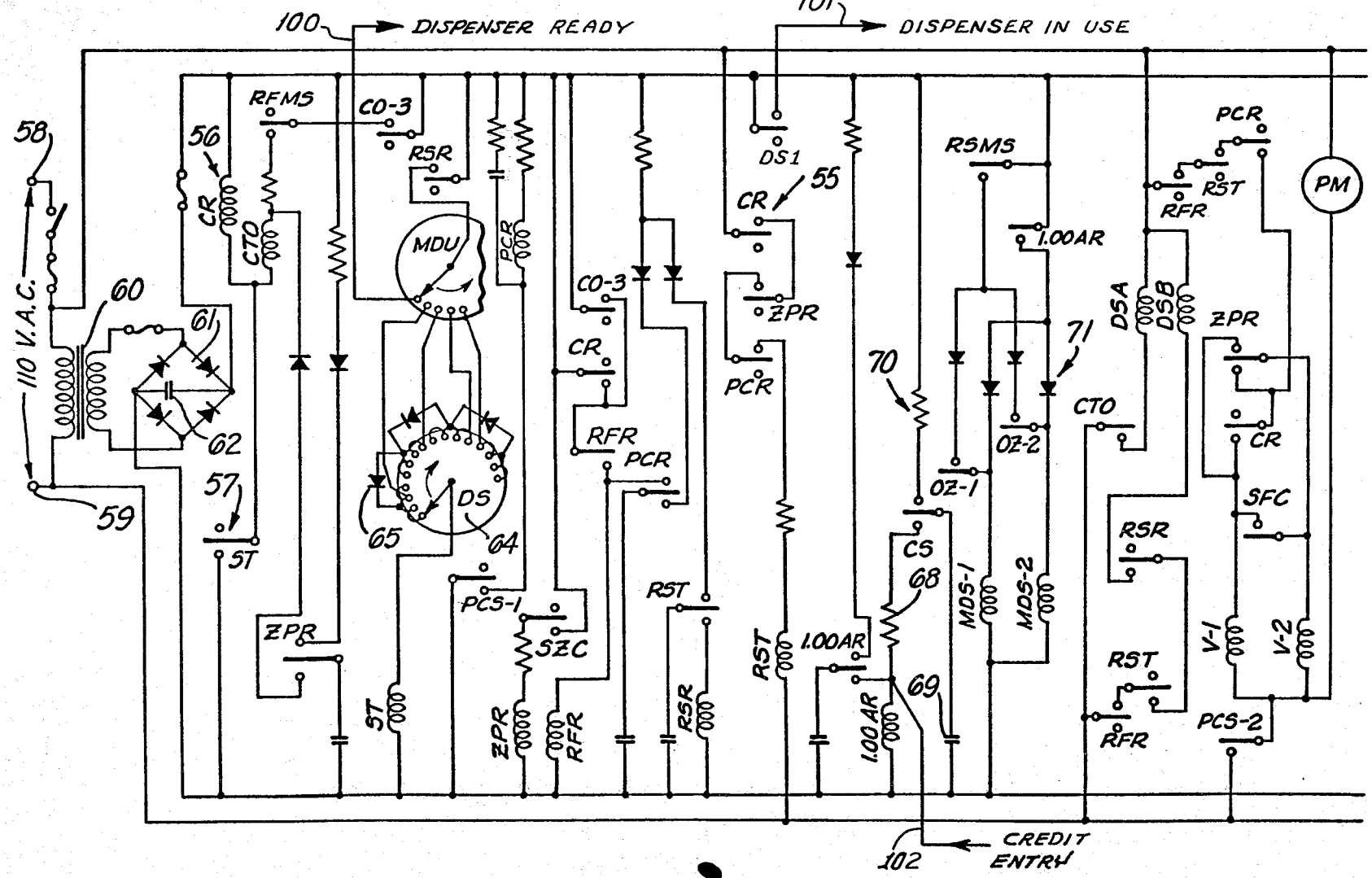
FIGS. 4*a* and 4*b* comprise an electrical schematic of the dispenser of FIG. 1.
Figure 4B:
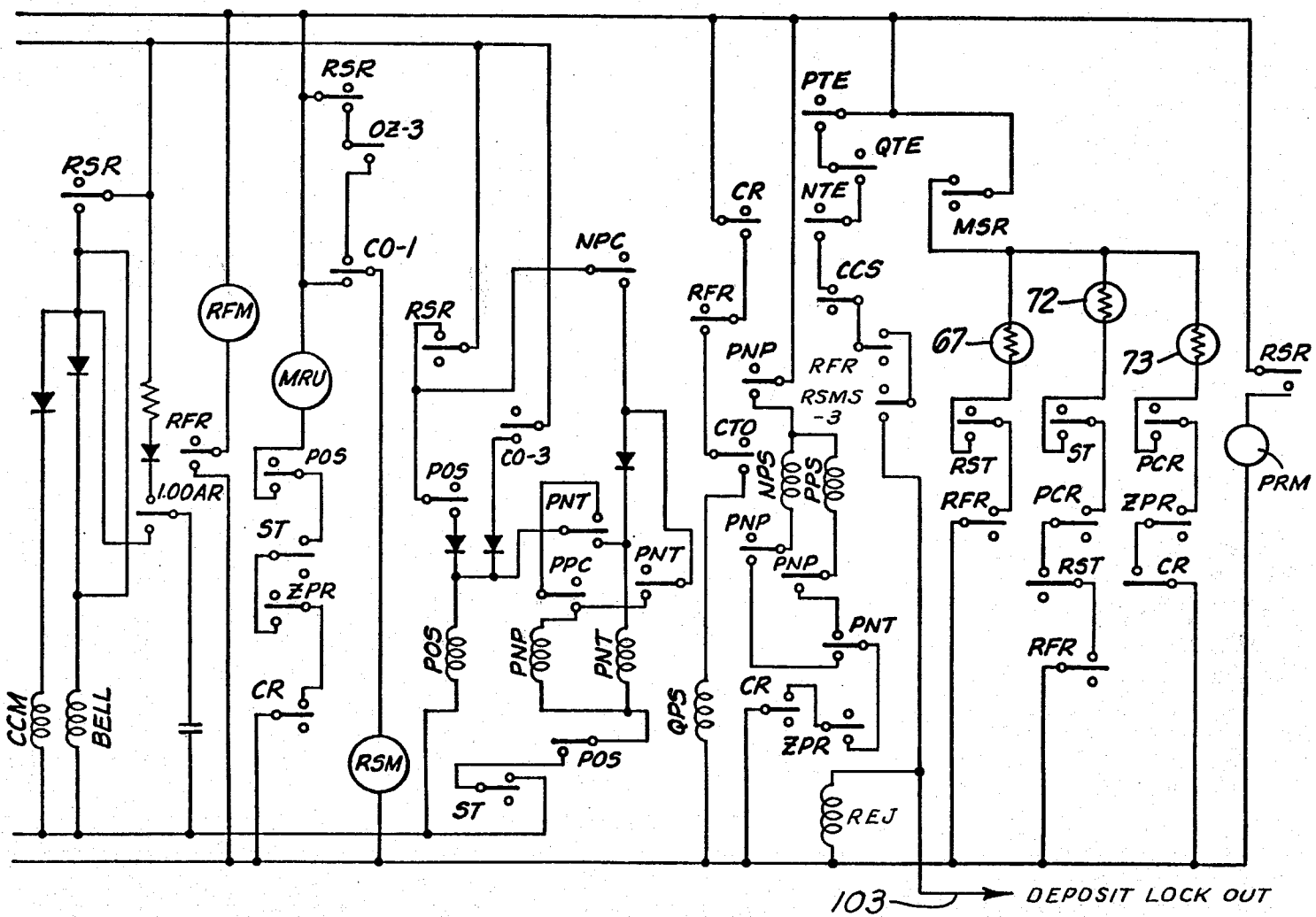
Figure 5:
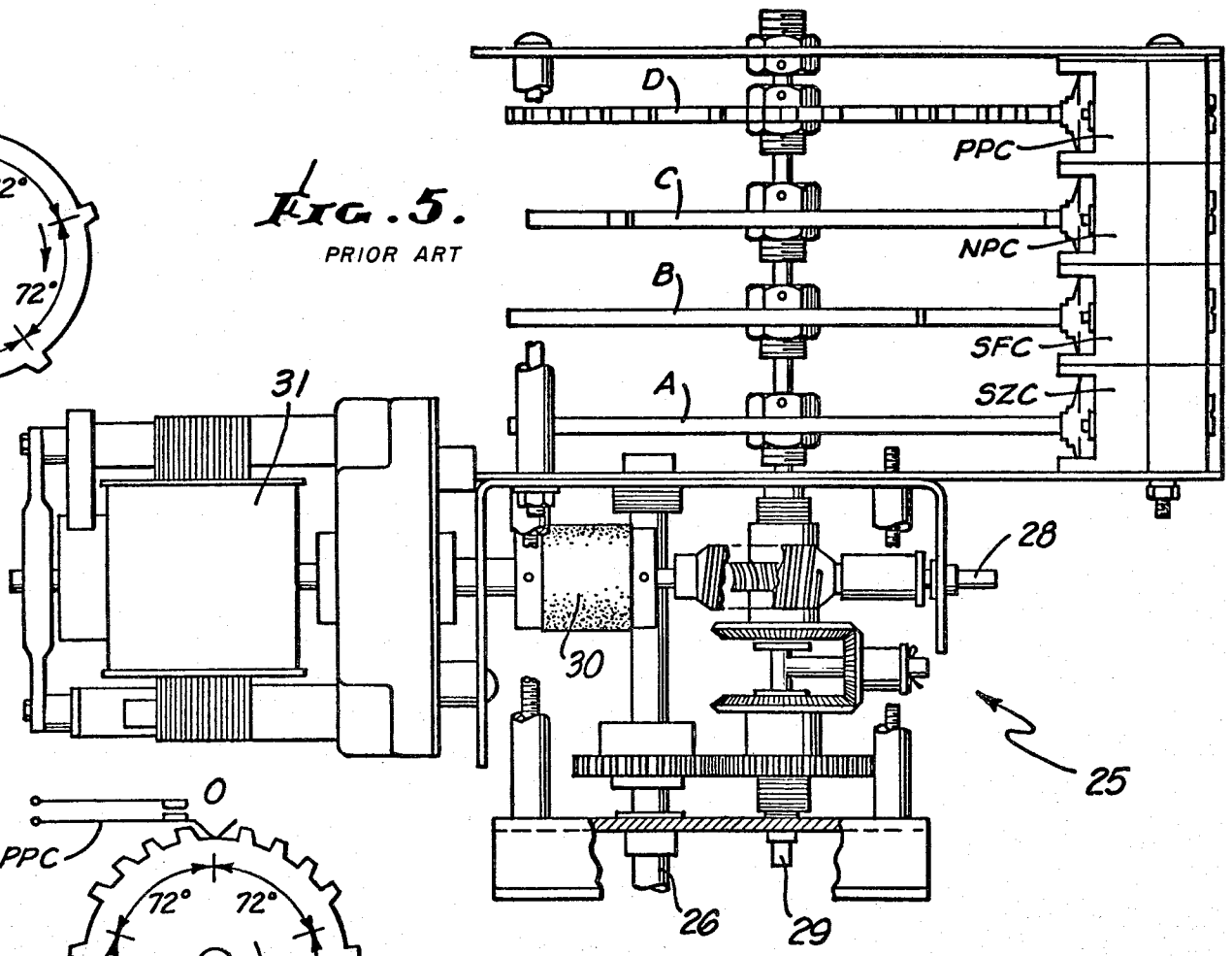
FIG. 5. PRIOR ART
FIG. 5 is an enlarged side view of the resolution unit of the dispenser of FIG. 1.
Figure 8:
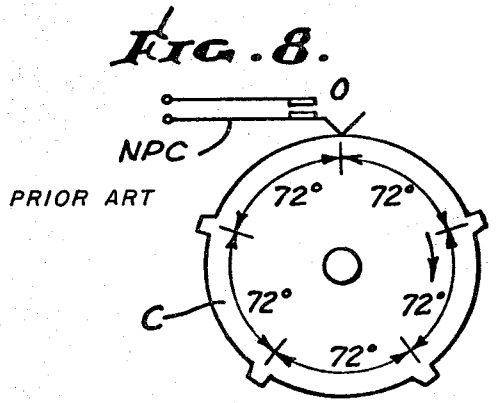
FIG. 8. PRIOR ART
Figure 9:
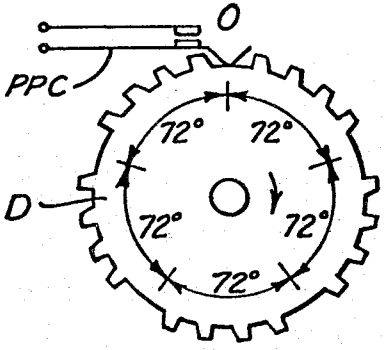
FIG. 9. PRIOR ART

The electrical circuitry for the system is illustrated if FIGS. 4*a* and 4*b*, and the various components are identified in Table I.

Most of the components are switches, relay coils, relay contacts, solenoid coils, motors, lamps, resistors, diodes and capacitors and are conventional in construction and operation. By way of example, reference numeral 55 indicates a set of contacts of the credit relay CR and reference numeral 56 indicates the coil of the CR relay. The moving arm of the contact set 55 engages the upper fixed contact when the coil is unenergized and engages the lower fixed contact when the coil is energized. The coil for the credit relay CR is energized when the stop relay ST is energized, closing contact set 57.

The system is powered from a 110 volt ac source connected at terminals 58, 59. A voltage step-down transformer 60, a full wave rectifier 61, and a filter capacitor 62 provide a 24 volt dc power source for some of the components.

The system includes a counter, typically a solenoid actuated stepping switch 64, referred to as the delivery stepper DS. The delivery stepper has a plurality of fixed contacts and a moving arm which is advanced from one contact to the next. In the system described in this application, 36 contacts are utilized, although only a portion of the contacts are illustrated in FIG. 4. Each step corresponds to one delivery unit of 25 cents and 36 contacts provide a nine dollar capacity for the system. The delivery stepper is actuated by solenoids DSA and DSB. When DSA is energized, the stepper switch advances one step. When DSB is energized, the stepper switch is reset to the initial condition, as illustrated in FIG. 4. Contacts 1 through 4 are electrically interconnected. Contacts 5 through 8 are similarly interconnected. Each succeeding group of four contacts are similarly interconnected. A diode 65 is connected between the first group and the second group to serve as a blocking diode and prevent current flow from the first group to the second group. Diodes are similarly connected between each of the succeeding groups of contacts.

The monetary display unit 41 includes a stepping switch MDU having ten fixed contacts and a moving arm, with the moving arm actuated by the solenoid MDS-1. In the system illustrated herein, the ten fixed contacts of MDU correspond to the monetary values zero through nine dollars. The second or one dollar contact is electrically connected to the first group of four contacts of the delivery stepper DS, the third or two dollar contact is connected to the second group of four contacts of DS, and the succeeding contact of MDU are similarly connected to succeeding groups of DS.

Other conventional counter units, such as relay or transistor types, may be used for either or both of DS and MDU if desired. The functions of the remaining components of the system will readily be apparent from the description of operation which follows.

When the system is in the start position, ready to accept coins, the monetary display unit MDU is in the zero position. The first legend lamp 67 is energized from the ac line through RST and RFR. When the customer drops a one dollar token in the coin slot, coin switch CS is closed and energizes the one dollar add relay 1.00 AR, which in turn energizes MDS-1 energy that and MDS-2. A resistor 68 is connected in series with the coil of 1.00 AR for current limiting purposes. Resistors are similarly used in conjunction with a number of other coils in the circuit. A capacitor 69 is charged from the dc source through a resistor 70 and CS. When CS is actuated by a coin, the capacitor 69 is discharged into the 1.00 AR coil to provide a pulse of enrgy for actuating the relay. Capacitors are used similarly in conjunction with a number of other relays in the circuit. Diodes 71 are connected in circuit with MDS-1 and MDS-2 for blocking purposes so thAt current of only one polarity flows in the circuit. Diodes are similarly used in conjunction with other relays in the circuitry.

When the dollar token is deposited, both monetary display units advance one step, positioning the numeral 1 at the openings 43, 45. The arm on MDU is moved from the zero position to the one dollar position. A bell is also energized through 1.00 AR to provide an audible signal to the customer. The customer may deposit additional dollar tokens to a total not to exceed nine dollars. As each additional token is deposited, the process is repeated to advance MDU one step. A coin count switch CCS is mouted on MDU and is opened after nine dollars have been deposited. When CCS is opened, the reject solenoid REJ in the coin handling unit 30 is de-energized to return to the customer any additional token deposited, since this particular system has a maximum capacity of nine dollars. Tokens are also returned when any of the normally closed tube empty switches PTE, NTE, QTE is opened, indicating that the supply of coins for refunds is depleted. The reset motor zero position switch RSMS-3 is in series with REJ, with RSMS-3 closed when RSM is stopped and open when RSM is running.

With the deposit of the first coin and activation of 1.00 AR, lamp 67 for the first legend is turned off and lamp 72 for the second legend is energized by operation of RST and ST, indicating to the customer that gasoline can be dispensed. Legend 2 instructs the customer to turn the handle 18. when the handle 18 is rotated to the on position, PCS-1 is closed and the flow meter 15 is reset to zero by the pump reset motor PRM. When resetting of the flow meter is completed, PCS-2 is closed to provide power to the valve solenoids VL, V2, and to the pump motor PM. Operation of PCR also turns off power to the legend 2 lamp 72. After placing the nozzle 17 in the tank of his automobile, the customer may operate the lever on the nozzle in the customary manner and gasoline flows through the system.

As gasoline is dispensed, the flow meter 15 registers the amount and the output shaft 20 drives the cams of the resolution unit 25. As cam A moves from its start or zero position, switch SZC is closed to energize the zero position relay ZPR, which in turn energizes the credit take-off relay CTO. Operation of CTO energizes DSA causing the delivery stepper DS to advance one step or one delivery unit. The cams on the resolution unit 25 make one full revolution for each delivery unit or 25 cents' worth of gasoline dispensed. Each revolution causes one operation of SZC and causes DS to advance one step.

A closed circuit between the moving arm of DS and the moving arm of MDU energizes the stop relay ST and the credit relay CR. This is a permissive circuit which allows gasoline to be dispensed. If one coin has been deposited, the MDU arm will be at the second contact or one dollar position. This permissive circuit will remain closed while DS moves through the first four steps. If two coins have been deposited, the circuit will remain closed through the first eight steps, and so forth for each additional coin deposited. When the delivery stepper DS moves one step beyond the corresponding point on MDU, this permissive circuit is interrupted and ST and CR are de-energized.

At this point in the cycle, cam A on the resolution unit 25 has moved past the zero position, SZC is closed providing power to ZPR, and gasoline flow continues, since gasoline flow is permitted as long as either ZPR or CR is energized. When a revolution of cam A is completed and the zero position is reached, SZC is opened and ZPR is de-energized. CR has already been de-energized and gasoline flow is stopped. Cam B closes switch SFC during the first 215° of each revolution. During any revolution when CR is de-energized and ZPR is energized, opening of SFC interrupts power to V1 to close one valve and cause a reduced rate of flow during the last 10 cents' worth of delivery. When ZPR and CR are de-energized, the third legend lamp 73 is lighted.

The preceding description covers the operation of the system when the value of the gasoline delivered to the customer is the same as the value of the tokens deposited by the customer. When the value of the gasoline delivered is less than the value of the tokens deposited, the operation during delivery of gasoline is as described above to the point where delivery is interrupted. For example, if the customer has deposited three tokens, MDU is at the fourth contact indicating three dollars. If delivery of gasoline is stopped by the customer or by the automatic shutoff in the nozzle, before the customer has received gasoline equal in value to three dollars, the system will refund the difference. After delivery is stopped, the nozzle is returned to its cradle and the handle 18 is turned to the off position, the refund portion of the system becomes operative. Suppose the customer has received gasoline of a value $1.37. DS will have stepped six times and be at the seventh contact, the permissive circuit through MDU and DS will be complete and ST and CR will be energized. The permissive circuit will not be broken until DS has stepped 12 times and reaches the thirteenth contact.

When the handle 18 is turned to the off position, PCS-1 is opened, de-energizing PCR and enegizing the refund relay RER which supplies power to the refund motor RFM. RFM drives a cam which actuates the refund motor switch RFMS. When as in the example being discussed, CR and RFR are energized when PCR is de-energized, actuating RFMS energizes the credit take off relay CTO to actuate DSA and advance DS one step. Actuation of CTO also energizes the quarter pay solenoid QPS to drop one 25 cent piece from the storage tube 35 into the receptable 38. This pay out process is repeated until DS steps beyond its match point with MDU at which time ST and CR are de-energized. RFM continues to run until it arrives at its zero or start position at which time the carryover switch CO-3 is opened, RFR is de-energized and RFM stops.

In the example being discussed wherein three dollars in tokens was deposited and $1.37 in gasoline was delivered, RFM will cause DS to step six times to position 13, returning a quarter for each step, with a total of six quarters or $1.50. When ST is de-energized the penny, nickel pay relay PNP and the penny, nickel transfer relay PNT are enabled and relay POS is energized through CO-3 providing power to the motor 31 (MRU) of the resolution unit 25. The cams of the resolution unit stop in an intermediate position when gasoline flow is stopped. MRU continues to drive the cams in the same direction. Rotation of cam D operates the penny-pay switch PPC to energize the penny pay-out solenoid PPS, via a closed contact set on PNT. Each impulse to PPS results in a penny being paid out from the storage tube 37. This penny pay-out action is repeated until cam C actuates NPC. In the specific example being utilized, PPC would be actuated three times, refunding three pennies, and then NPC would be actuated. Actuation of NPC energizes PNT, opening the circuit to PPC and preventing further penny refunds. Energizing PNT also completes a circuit to the nickel pay-out solenoid NPS to refund a nickel from the storage tube 36. MRU continues to drive the cams and each time NPC is actuated, NPS is energized to refund another nickel. The cam rotation continues until the resolution unit returns to the zero or start position and SZC is actuated, de-energizing ZPR, MRU and PNP to prevent further refunds. In the specific example utilized, two nickels were refunded with a total refund comprising six quarters, three pennies and two nickels for a sum of $1.63.

Actuation of SZC also energizes the reset timer RST. After a delay built into the reset timer, typically eight to ten seconds, the contact sets of the reset timer are actuated to provide the resetting operation.

Actuation of RST after the delay time interval expires produces a number of functions which reset the system to the initial or start condition. The reset relay RSR is energized. The reset motor RSM is energized through the off zero switch OZ-3 on the monetary display unit actuated by MDS-1. RSM drives a cam which actuates reset motor cam switch RSMS ten times in a revolution to energize MDS-1 and MDS-2 for advancing both monetary display units to the zero or start position. When the monetary display unit 41 is at the zero position, the circuit to MDS-1 is opened at off zero switch OZ-1 and when the monetary display unit 44 is at the zero position, the circuit tio MDS-2 is opened by off zero switch OZ-2. The circuit to RSM is opened by off zero switch OZ-3, but the motor is energized through a carry-over switch CO-1 which permits the motor to drive the cam to the zero or start position.

Actuation of RST and RSR also energizes DSB to return DS to the start position. The bell is energized via RSR to provide an audible signal indicating that reset has taken place. Lamp 73 for legend 3 is turned off when PCR is de-energized. Lamp 67 for legend 1 is also energized by the actuation of RST, indicating to a customer that the system is ready for a new cycle of operation.

This apparatus will accept money or the equivalent in sales units of one dollar steps up to the maximum of nine dollars. The system delivers gasoline at a relatively high rate in dispensing units of 25 cents. After dispensing is completed, the system pays out a refund in dispensing units until they are used up. The system operates at a slower rate to pay out the remaining change in pennies and nickels. This arrangement permits accuracy in operation at the small change level while permitting gasoline delivery at the normal rates of operation. The magnitudes selected for the sales unit, dispensing unit and coin pay-outs are of course arbitrary and have been selected for use with the monetary system in the United States. Various alternatives are usable. In one variation, the dispensing unit can be made the same magnitude as the sales unit.

While the embodiment illustrated utilizes the deposit of a coin or token to operate the coin switch CS and initiate the registration of a sales unit, other mechanisms can be used to register a sales unit and the electrical function for registering a sales unit can be produced from a remote position if desired. When dispensing of gasoline is terminated, the position of the delivery stepper DS and the cams of the resolution unit provide a direct indication of the amount of gasoline dispensed. This information is utilized in the present system to control the pay out of money for a refund. The positions of these components could also be used to generate signals indicating the amount of gasoline dispensed for record purposes and could be used for paying out trading stamps or the like covering the amount purchased.

TABLE I

| Code: | Unit |
|---|---|
| CCS | Coin count switch on MDU. |
| CO-1 | Carry over switch on RSM. |
| CO-3 | Carry over switch on RFM. |
| CR | Credit relay. |
| CS | Coin switch. |
| CTO | Credit take off relay. |
| DS | Delivery stepper. |
| DSA | Delivery stepper coil A. |
| DSB | Delivery stepper coil B. |
| MDS-1 | Monetary display solenoid No. 1. |
| MDS-2 | Monetary display solenoid No. 2. |
| MDU | Monetary display unit. |
| MRU | Motor resolution unit. |
| NPC | Nickel payout switch (cam C). |
| NPS | Nickel payout solenoid. |
| NTE | Nickel tube empty switch. |
| OZ-1 | Off zero switch — MDS-1. |
| OZ-2 | Off zero switch — MDS-2. |
| OZ-3 | Off zero switch — MDS-1. |
| PCR | Pump control relay. |
| PCS-1 | Pump control switch No. 1. |
| PCS-2 | Pump control switch No. 2. |
| PM | Pump motor. |
| PNP | Penny, nickel pay relay. |
| PNT | Penny, nickel transfer relay. |
| POS | Payout safety relay. |
| PPC | Penny payout switch (cam D). |
| PPS | Penny payout solenoid. |
| PRM | Pump reset motor. |
| PTE | Penny tube empty switch. |
| QPS | Quarter payout solenoid. |
| QTE | Quarter tube empty switch. |
| RES | Coin reject solenoid. |
| RFM | Refund motor. |
| RFMS | Refund motor can switch. |
| RFR | Refund relay. |
| RSM | Reset motor. |
| RSMS | Reset motor cam switch. |
| RSMS-3 | Reset motor zero position switch. |
| RSR | Reset relay. |
| RST | Reset timer. |
| SFC | Slow flow switch (cam B). |
| ST | Stop relay. |
| SZC | Substract & zero position switch (cam A). |
| V1 | Valve solenoid No. 1. |
| V2 | Valve solenoid No. 2. |
| ZPR | Zero position relay. |
| 1.00 AR | $1.00 add relay. |

TABLE II

| Step: | Legend |
|---|---|
| 1 | Deposit coins. |
| 2 | Remove nozzle; turn red handle. |

TABLE II-continued

| Step: | Legend |
|---|---|
| 3 | Return nozzle. |

Figure 11:
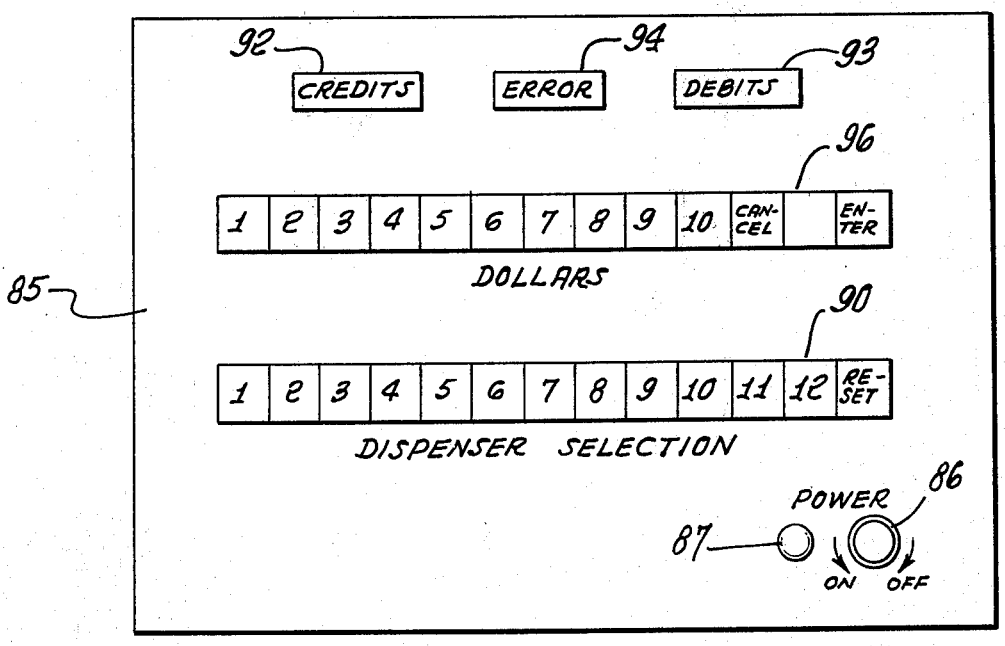
FIG. 11 is a view of the control console for the booth of the service station of FIG. 10.

The legends of Table II may be modified so that the legend for step 1 reads "Pay at booth" when the dispensers of FIGS. 1–9 is used with the control unit of FIGS. 11 and 12.

The Control Unit

Figure 10:
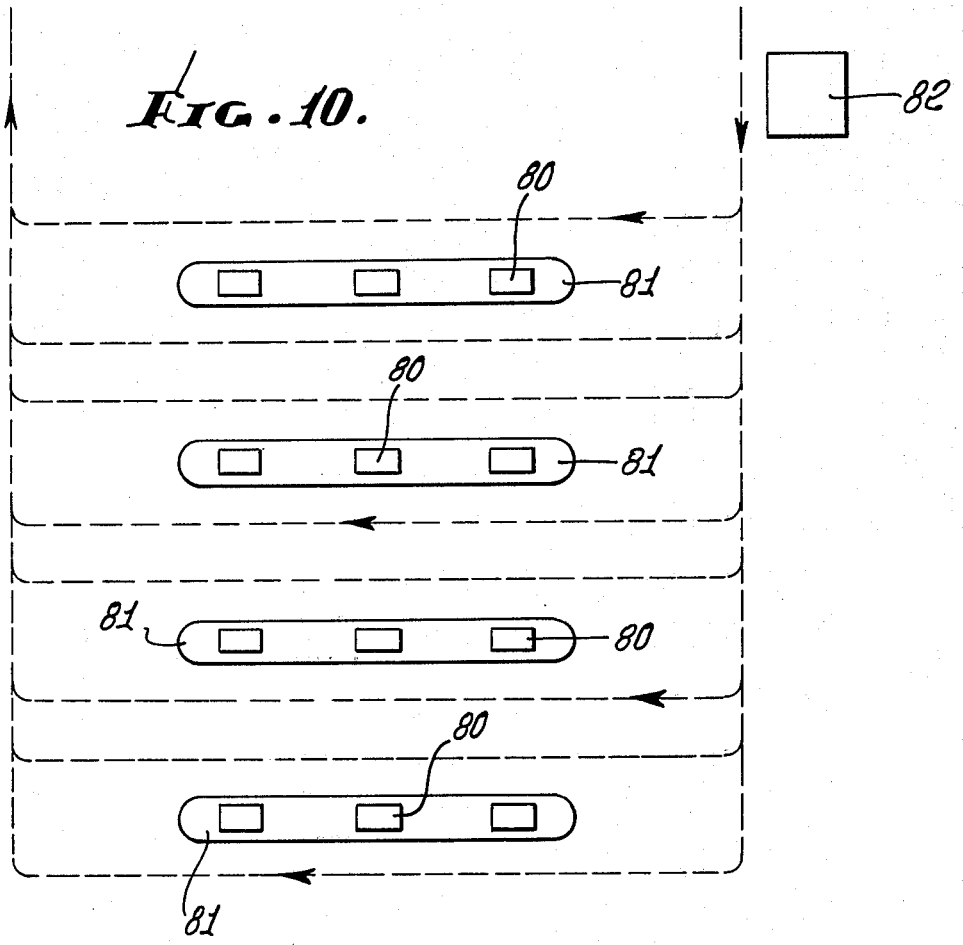
FIG. 10 is a diagram of a gasoline station incorporating the presently preferred embodiment of the invention.

A plurality of dispensers 80 are mounted at islands 81 in the service station of FIG. 10. Typically, twelve dispensers will be utilized, with three dispensers per island, the dispensers being of the type described in conjunction with FIGS. 1–9 hereof. The attendant for the station is positioned in a booth 82 with a console or control unit for controlling the dispensers 80. The traffic pattern through the station is shown by the dashed lines, with customers first stopping at the booth to pay the attendant and then driving to an island to obtain the gasoline and change.

Alternatively, the control unit may be located at one of the islands and the customer makes payment after stopping at a selected dispenser, and may even remove the nozzle from the dispenser and insert it in the vehicle before paying the attendant. The location and time of payment are not critical.

Figure 12A:
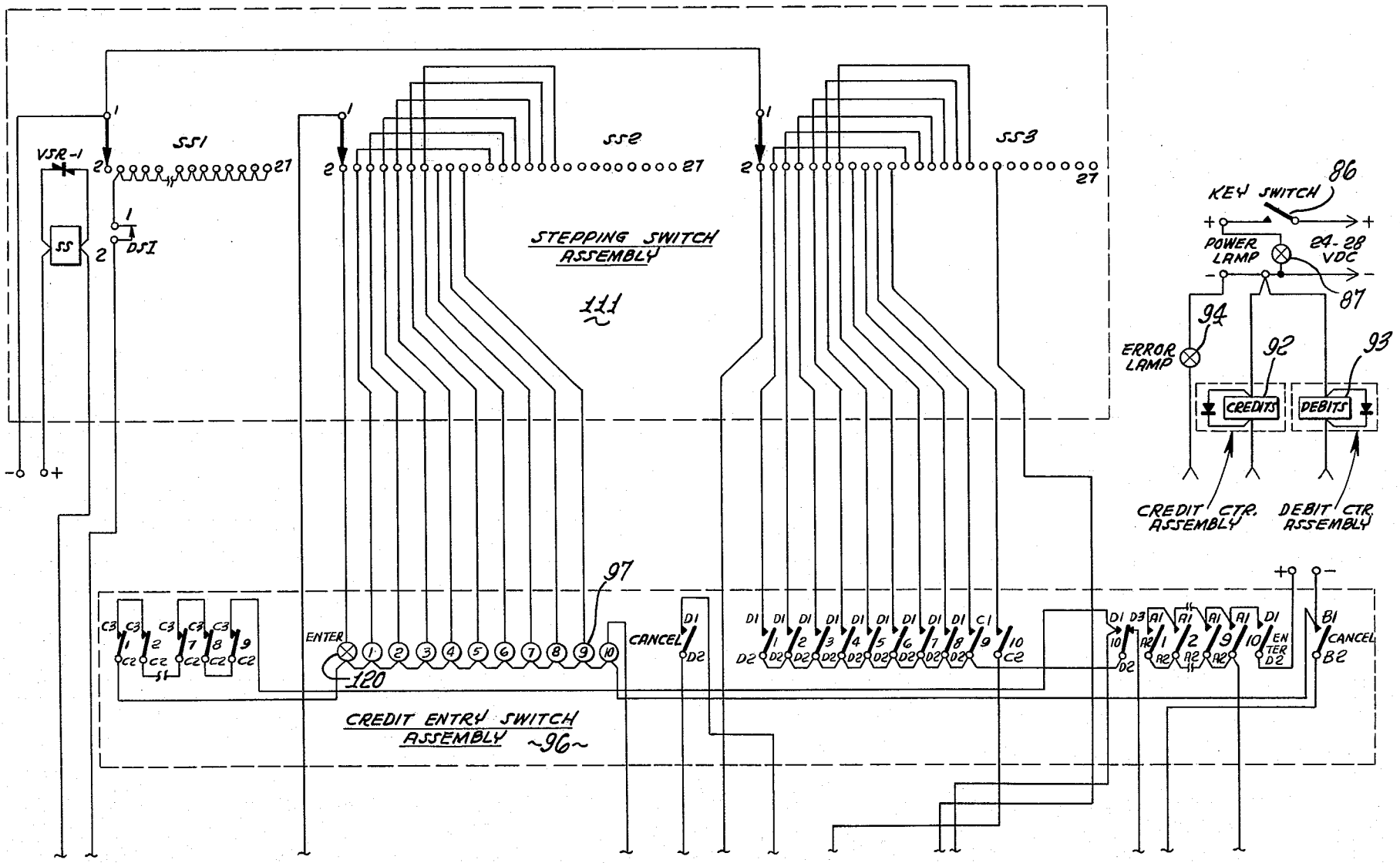
FIGS. 12*a* and 12*b* are an electrical schematic of the control unit for the station of FIG. 10.
Figure 12B:
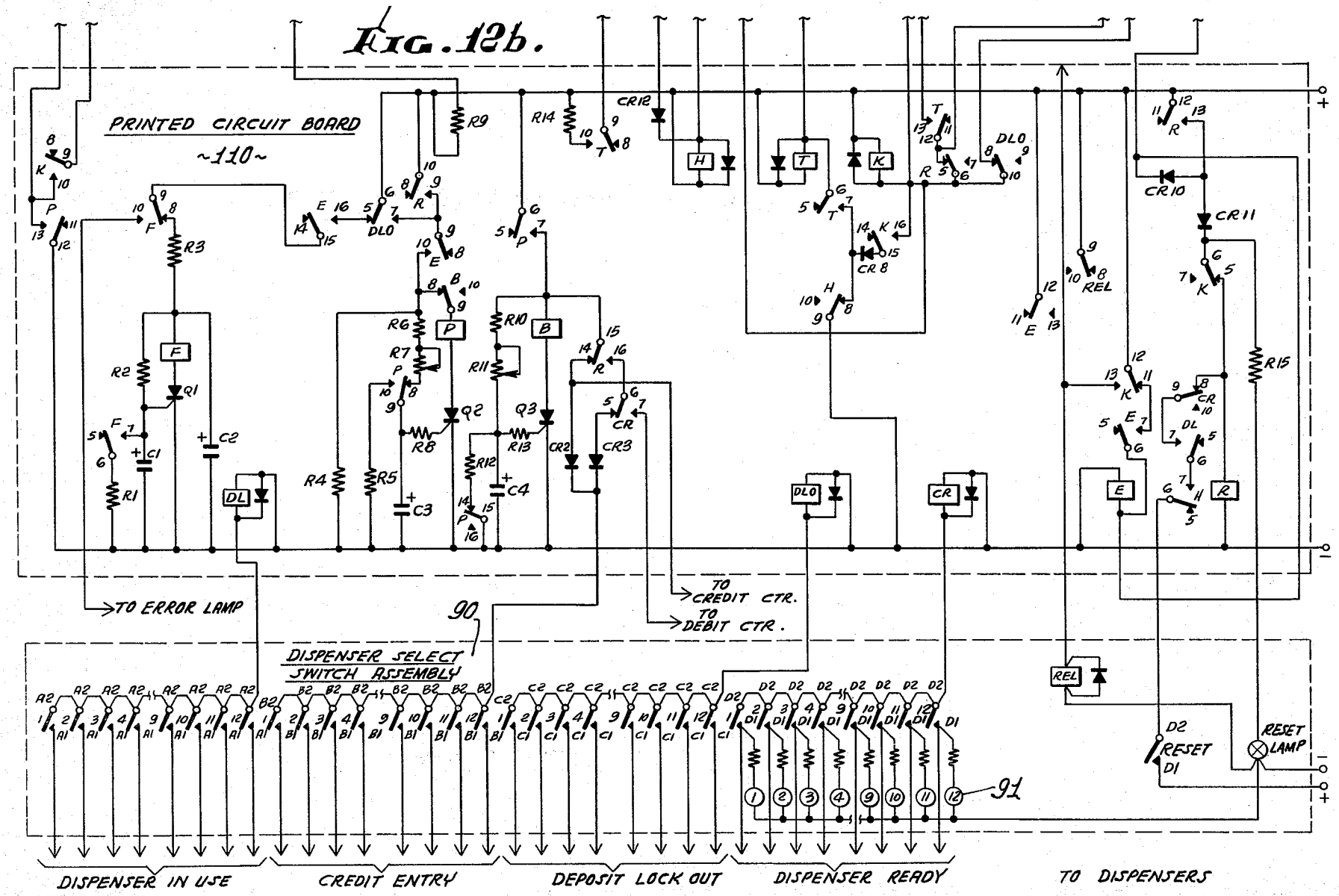

The control console at the booth 82 is shown in FIG. 11 and the electrical circuitry is shown in FIGS. 12*a* and 12*b*. A number of lights and switches are mounted on a panel 85 for viewing and operation by the attendant. Main power switch 86 provides the elecric power to the control unit, and light 87 indicates when the power is on.

A thirteen unit multiple push button switch 90 provides for selection of one of the 12 dispensers. This dispenser selection switch is sometimes referred to as the dispenser select switch assembly and includes four contact sets A, B, C, D for each dispenser. The thirteenth unit of switch 90 is the RESET switch. Each unit of the switch 90 has a built in light 91.

Another thirteen unit multiple position switch 96 provides for entering a number of units to be dispensed, typically in dollars or gallons. This dollar value switch is sometimes referred to as the credit entry switch assembly and may be identical to the switch 90, with lights 97. In the embodiment illustrated the value switch 96 uses positions 1–10 for dollars, position 11 for CANCEL and position 13 for ENTER, with position 12 not used, but it is readily understood that the system of the invention can be utilized for any number of dispensers and any number of value units. A credit counter 92, a debit counter 93 and an error light 94 are also mounted on the panel 85.

To enable the control unit to interface to the dispenser described in U.S. Pat. NO. 3,605,973, the following modifications are made to the dispenser.

1. The credit stepper/indicators (MDU) now have 18 steps with 0 to 16 credit indication. In the zero position a wire is added to produce the Dispenser Ready signal on line 100. When in the zero position, positive dc voltage is supplied to the console to illuminate the light 91 for that dispenser. This indicates to the attendant that the dispenser is not being used and is therefore ready for use by a new customer. This signal is also used during debiting to indicate that MDU has stepped forward to the zero position. The eighteenth step on MDU is not wired, and has only been included to make the interface compatible with other dispensers as well. The coin count switch CCS which previously opened after nine dollars now opens after 16 dollars have been credited. All other MDU functions are as described in the patent.

2. The delivery stepper DS now has the capability of stepping off quarters for sixteen dollars and has one blank position following this count. Therefore DS has at least 65 positions wired in groups of four as before. A contact DS1 has been added to DS. This contact is mechanically coupled to DS such that it only closes when the DS wiper is at the home position, and applies a positive dc signal to the Dispenser in Use line 101. This signal is used to indicate to the console that flow has not commenced and thus enable the debiting function should it be required. All other functions of DS are as described in the patent.

3. A Credit Entry line 102 is added to enable remote entry of Credits from the console.

4. A Deposit Lock Out line 103 is added to indicate through removal of positive dc voltage to the console, that the dispenser cannot accept credits. The cricuitry for this signal has been re-arranged as shown to separate the line 103 from input terminal 59. The REJ coil is part of the coin acceptance unit and is not required when the remote console is used for adding credits.

The control unit as shown in FIGS. 12*a* and 12*b* is of modular construction and includes a printed circuit board 110, the dispenser select switch assembly 90, the credit entry switch assembly 96, and a stepping switch assembly 111. The stepping switch assembly 111 has a solenoid SS and three decks SS1, SS2 and SS3. A 26 position switch is used because of its availability, but only 19 positions are actually used, providing a home position plus eighteen positions corresponding to the eighteen positions of the dispenser credit stepper. Only 17 positions are needed for the $16.00 limit, but the 18 position stepper was used because of its availability.

Printed Circuit Board

The printed circuit board 110 contains 12 relays and associated control circuits. Relays are labelled and perform the following functions:

Relay DL

With a Dispenser Select Switch operated, DL will only be operated if the dispenser Delivery Stepper DS, DS1 is at zero, indicating that flow has not commenced. The primary function of this relay is to inhibit Dispenser Reset from the console if flow has commenced.

Relay DLO

With a Dispenser Select Switch operated, deposit lock out relay DLO will be operated only when credits may be entered into the selected dispenser. Examples of when relay DLO would not be operated are:

a. The selected dispenser is out of change.
b. The dispenser already contains the maximum credits possible.
c. The dispenser is in its Reset cycle.
d. Power to the dispenser is off.

The primary functions of this relay are to prevent credit entry during the conditions outlined above and to indicate an Error condition if credit entry is attempted.

Relay CR

With a Dispenser Select Switch operated, relay CR will be operated only when the dispenser Credit Stepper is in the zero position. The primary function of this relay is to control the Credit and Debit Counters 92, 93.

Relay H

Relay H operates only when the stepping switch is in the Home position indicating that a Credit Entry or Reset from console sequence is complete and restores all circuits to normal upon detection of this condition.

Relay T

Relay T operates and locks in due to its own contacts T6, T7 and relay H contacts H8, H9 during a credit entry sequence if the $10.00 credit switch C2 is operated. This transfers control of relay K to credit entries exceeding $9.00.

Relay K

Relay K has two major functions. These are:

a. To detect when the selected quantity of credits have been entered into a selected dispenser.
b. Upon completion of credit entry or console generated reset to restore the Stepping Switch to its Home position and to release all actuated push-buttons.

Relay E

Relay E when operated, completes the circuit applying power at E9, E10 to generate pulses to enter credits and energize the Stepping Switch coil. (Pulse generation is covered under relays P and B below).

Relay R

Relay R when operated, causes resetting of the selected dispenser credits to zero. This relay is operated by operating the Reset push button which applies positive voltage via H6, H7, DL6, DL7, CR9, CR8 to R1. Through this network it will be seen that relay H must be operated (Stepping switch in Home position), relay DL must be operated (Dispenser Delivery stepper at zero), relay CR must be released (Dispenser Credit stepper off zero). Once operated, relay R will lock through R12, R13, CR11, K6, K5, to relay R, and will remain locked until relay K operates.

Relay F

Relay F is the Error lamp flasher relay. The flasher circuit consists of relay F, silicon controlled rectifier Q1 (thyristor), capacitors C1 and C2, and resistors R1, R2 and R3. The circuit is actuated by applying a positive voltage to F9 via DL06, DL05, E16, and E15, and results from the E relay being operated if the DLO relay is released. The flasher circuit functions as follows:

The voltage at F9 is applied via F8 and R3 to C2. At C2 the voltage will rise from zero to the applied voltage at a rate determined by the value of C2 and R3. (Approximately 0.12 seconds). The voltage at Q1 anode via the coil of relay F will also be the same as the voltage at C2. Thyristor Q1 will not conduct since its gate voltage is less than that required for it to be triggered. Approximately 0.8 volts is required to trigger Q1 and this voltage is applied via R2 to C1 and the gate of Q1 and will rise to this voltage according to the time constant of R2 and C1. (Approximately 0.5 seconds). At this time Q1 will conduct and operate relay F. Relay F will remain operated as long as enough voltage is applied for it to be held. Relay F operating removes power from the flasher circuit at F8 and also discharges C1 via F7, F6 and R1. Voltage is maintained for approximately 0.5 seconds by the charge on C2. When the voltage decreases to a point where the current flowing through Q1 is not enough to sustain conduction, Q1 will turn off and release relay F. Relay F releasing restores the circuit to its original configuration and the sequence recommences. Relay F when operated lights the Error lamp via F9 and F10. Flashing will continue until either relay E is released or relay DLO operated.

Relays P and B

Relays P and B are part of the pulse generation circuits used to apply impulses to the Stepping Switch and add credits to the selected dispenser. This circuit consists of the following components: Relays P and B, capacitors C3 and C4, thyristors Q2 and Q3, variable resistors R7 and R11, and fixed resistors R4, R5, R6, R10, R12 and R13. Variable resistors R7 and R11 control the time between and time duration of the pulses respectively. With relay E and DLO or R operated, the pulse circuit will be energized and functions as follows:

The applied voltage at B8 charges capacitor C3 via R6, R7, P8, P9 at a rate determined by the setting of R7. When the voltage at C3 reaches the gate trigger voltage of Q2 (approximately 0.8 V), Q2 conducts causing relay P to operate. Relay P operating discharges C3 via P9, P10 and R5 and applies voltage via P6 and P7 to B1. Capacitor C4 now commences to charge at a rate determined by the setting of R11. When the voltage at C4 reaches the gate trigger voltage of Q3, Q3 conducts causing relay B to operate. Relay B operating removes voltage from relay P via B8, B9 now open and therefore releases relay P. Relay P releasing removes voltage at relay B via P6, P7 and the circuit is now restored to its original condition. Pulsing will continue until either relay E or both relays R and DLO are released.

Credit Entry $1.00 through $9.00

Dispensers that are ready for use will be indicated by illumination of their appropriate Dispenser Select light 91. Series resistors are used to drop the signal voltage from the dispensers to the lamps.

Operating the Dispenser Select button for an available dispenser connects the four Dispenser Control lines 100, 101, 102, 103 to the printed circuit board, and under normal conditions relays DL, DLO and CR will operate.

For the sake of description let us assume that $2.00 are to be entered in the dispenser. Prior to entry of credits the Enter push button lamp 120 should be illuminated indicating that the Stepping Switch 111 is in the Home position. Operating the $2.00 push button closes Credit entry switches 2D1 to 2D2 and 2A1 to 2A2, and opens switch 2C2 to 2C3. To initiate the Credit Entry sequence, the Enter push button is now operated and closes switch Enter D1 to Enter D2. A positive voltage is now applied via this switch through 2A1 to 2A2, to relay E which now operates and locks via E6 to E7, K11 to K12 to the 24V + line. The P and B relay pulse generator is now actuated through DL06 to DLo7 and E9 to E10. The pulse circuit now functions as described in the Relay Function section under Relays P and B. Relay P when operated performs these functions:

1. Relay contact P12 and P13 closes, operating the Stepping Switch coil SS. Note: The Stepping Switch wipers do not move at this time. Movement is accomplished upon removal of voltage from the SS coil.
2. Relay contact P6 to P7 closes applying positive voltage via R15 to R14, CR2, to the selected dispensers credit entry line. Note: The positive voltage applied to the dispenser Credit Entry line operates the Credit Stepper but this stepper does not advance until removal of the actuating voltage.
3. Relay contact P6 to P7 closing also applies positive voltage to the Credit indicator via R15 to R14, to the electro-magnetically operated Credit counter.

When relay B operates in the Pulse Generation circuit resulting in the release of relay P, the console Stepping Switch and Dispenser Credit stepper advance one position. The pulse sequence now continues until the Stepping Switch advances one more position ($2.00 credit entry). At this time relay K operates from negative voltage via SS3 wiper, terminal 4 of SS3, Credit Entry Switch 2D1 to 2D2, Credit Entry Switch 10D2 to 10D3, relay contacts R5 to R6 to relay K. Relay K operating locks via H9 to H8, CR-8, K15, K16 to relay K. The operation of relay K at this time performs three other functions:

1. K11 to K12 opening releases relay E thus terminating the pulsing sequence by opening the contact at E9 to E10.
2. The same contact closing at K12 to K13 applies a positive voltage to the Credit Entry and Dispenser Select push button release coil REL resulting in the release of all previously operated buttons.
3. Contacts K9 to K10 closing complete the circuit to Home the Stepping Switch via plus voltage, Stepping Switch coil SS, K10, K9, Stepping Switch interrupt contacts DSI-2 to DSI-1, SS1 contact bank, SS1 wiper to negative voltage.

The Stepping Switch now "runs" due to the self interrupting action of its DSI contacts. Running will continue until the Stepper wipers reach the Home position where the homing circuit is opened at the SS1 wiper. In the Home position, relay H operates disconnecting the relay K locking circuit at H9 to H8. Relay K now releases removing the power from the Credit Entry and Dispenser Select Pushbutton release coil REL.

The operation of the Pushbutton Release coil REL in switch assembly 90 disconnects the Dispenser Control lines resulting in the release of relays DL, DLO and CR. The Dispenser Select Pushbutton Lamp appropriate to the selected dispenser is now extinguished since the dispenser Credit Stepper is off zero. This lamp will re-illuminate following termination of the transaction when the dispenser Credit Stepper is reset to zero.

The console sequence is now complete and is ready for a further transaction with another dispenser, even though the originally selected dispenser is in the process of delivering gasoline.

Credit Entry —$10.00

Credit Entry of $10.00 is accomplished as with $1.00 through $9.00, with the following exceptions:

Initially instead of operating the $2.00 push button, the $10.00 push button is pressed. In this case Credit Entry switches 10C1 to 10C2, 10A1 to 10A2 and 10D1 to 10D2 will be closed.

Addition of credits will commence as before and following ten complete credit pulses the Stepping Switch wipers will be resting on contacts number 12. When this occurs, relay T will operate via negative voltage, SS3 wiper, SS3 contact 12, 10C1 to 10C2, to relay T. T relay operating locks via T6 to T7, H8 to H9 to negative voltage, and also causes relay K to operate via negative voltage, C3 to C2 contacts of Credit Entry switches 1 through 9, relay contacts T13 to T12 (now closed), relay contacts R5 to R6 to relay K. Homing of the Stepping Switch and clearing of the console is then accomplished as before.

Credit Entry $11.00 to $16.00

Credit Entry of $11.00 to $16.00 is accomplished as before with the following exceptions:

Credit selection is accomplished by pressing two of the Credit Select push buttons, $10.00 and any one of the $1.00 through $6.00 buttons. For the purpose of description assume that $14.00 are to be entered into a dispenser in which case both the $10.00 and $4.00 buttons would be operated. In this case, Credit Entry Switch contacts 4D1 to 4D2, 10D1 to 10D2, 4A1 to 4A2, 10A1 to 10A2 and 10C1 to 10C2 would be closed and 4C2 to 4C3 contacts would be open.

Addition of credits will commence as previously described and following fourteen complete credit input pulses the Stepping Switch wipers will be on contact 16. When this occurs relay K will operate via negative voltage, SS3 wiper, SS3 contact 16, SS3 contact 6, Credit Entry switch contacts 4D1 to 4D2 and 10D2 to 10D1, relay contacts T13 to T12 and R5 to R6 to K relay. As before, operating K will clear the Console.

Note: Relay K did not operate at $4.00 credit because with the $10.00 button operated, routing of power to relay K is through an open contact of relay T at T13 to T12, and the T relay does not operate until ten credits have been entered. Similarly, relay K did not operate at $10.00 because the Credit Entry switch 4C3 to 4C2 was open removing the negative source of voltage at 10D1.

Addition of Credits to a Dispenser in Use

Credits may be added to a dispenser at any time during a transaction and console functions will be as described above with the exception that since credits already exist on the dispenser, the appropriate Dispenser Select button light will not be lit and relay CR will not be operated.

Credit Entry Exceeding $16.00

The maximum amount of credits entered is determined by the dispenser. Indication of this maximum is transmitted to the Console by the removal of voltage from the Deposit Lock Out Line which will cause relay DLO to release. During credit entry DLO releasing removes the voltage from the pulse generator circuit at DL06 to DL07. This voltage is now applied to DLO5 and the Error flasher circuit via E16 to E17. Movement of the Stepping switch now ceases and the Error light flashes continuously. The quantity of credits added to the dispenser during this transaction is indicated by the illumination of the appropriate Credit Entry push button lamps. A determination of how many credits were not accepted by the dispenser can be made by subtracting the quantities indicated by the illuminated Credit Entry push buttons from the locked operated push buttons. The Error lamp will continue to flash until the console is cleared by operation of the Cancel push button.

Cancelling a Console Operation

Clearing the console of operated push buttons or if an error is indicated can only be accomplished by pressing the Cancel button. This button only functions if an Error is indicated or if a legal Credit Entry or Reset is not in process. Two cancelling circuits are used for different conditions:

1. If it is realized that incorrect push buttons have been operated prior to the Enter or Reset buttons being pressed.

If incorrect push buttons have been operated and the console has not commenced sequencing, the Console Stepping Switch will be in the Homeposition and the negative supply line will be connected via SS3 wiper, SS3 contact 2, CR12, Cancel D2 to D1, to relay K at K4. K relay operating applies + voltage via K12 to K13, to the Push button release solenoid REL which operates and releases all operated push buttons. Had an Enter or Reset sequence been in process, the circuit to relay K would have been incomplete due to the SS3 wiper being off the Home position.

2. If an Error is indicated.

If a console Error is indicated, due to DLO being released, operation of the Cancel push button will apply negative voltage via Cancel B1 to B2, DLO8 to DLO9 to relay K at K4. K relay operating Homes the Stepping Switch and restores the console to its normal condition.

Resetting a Dispenser From the Console

A normally operating dispenser can only be reset by the console if that dispenser has had credits added and product flow has not commenced. Functioning of the Reset sequence is also inhibited during the Credit Entry sequence. Resetting is accomplished by first operating the Dispenser Select push button for the appropriate dispenser followed by operation of the Reset push button. If the selected dispenser has not commenced flow, relay DL will be operated, and if the dispenser credit stepper is off zero, relay CR will be released and now, provided the console is in its normal state operation of the Reset push button will apply + voltage from via Reset D1 to D2, relays H6 to H7, DL6 to DL7, CR9 to CR8 to relay R. Relay R will now operate and lock from the + voltage applied via contacts R12 to R13, CR11, K6 to K5 to relay R. The Reset push button will illuminate and will remain illuminated until relay R releases at the end of reset. Relay R operating will also cause relay E to operate via R12 to R13, CR10 to relay E. Relay E then locks in via E6 to E7, K11 to K12 to + voltage. With relays R and E operated, the pulse generator circuit will now be activated by the applied + voltage via relay contacts R9 to R10 and E9 to E10. With pulses being generated, the Stepping Switch will travel one step with each impulse, but since relay R is operated the impulses will not feed the Credit Counter as in other sequence due to the open contacts at R15 to R14. Following a quantity of steps determined by the quantity of steps remaining on the Dispenser Credit Stepper until that stepper steps forward to its zero position, the CR relay will operate. This transfers pulses from the Credit Entry line to the Console Debit Counter via contacts R15 to R16, CR6 to CR7. Pulses will now continue registering on this counter until the wiper of SS3 reaches contact 20 where the circuit is now complete to operate relay K via S4-18 negative voltage, SS3 wiper, SS3 contact 20, to relay K. The console now clears as in other sequences.

To demonstrate the debiting action of the console, assume that four credits exist on the dispenser. In order for the Dispenser Credit Stepper to reach zero, 14 credit input pulses will have to be generated from the console. Once this has been accomplished, the console CR relay will operate and the console Stepping switch will be on contact 16 (contact 2 + 14 steps). At this time CR operating will disconnect pulses from the dispenser Credit Input line and transfer pulses to the Debit Counter. Four more pulses will be required for the console Stepping switch to reach contact 20, after which the console clears. All four of these pulses are directed to the Debit Counter and thus four credits are recorded on this counter.

By way of further explanation, the credit stepper in the dispenser with 18 steps serves as a register for storing the dollar value of the gasoline purchased such as four. After the amount purchased has been entered, the console stepping switch advances to the Home step. When the Reset button is closed, the console pulse generating circuit is started to advance both the dispenser credit stepper and the console stepping switch. However these advances are not counted on the credit counter.

The dispenser credit stepper advances from the four step to the eighteen step and the console stepping switch advances fourteen steps. The pusle generating circuit continues to run for four more pulses to advance the console stepping switch to eighteen and Home. The dispenser credit stepper goes to zero and remains there, and the four pulses are counted by the debit counter, thereby clearing the dispenser of credits and recording the amount debited.

In the preceding example, the number of steps in the dispenser credit stepper and the console stepping switch is 18, and 14 pulses are required to advance the dispenser credit stepper from its position subsequent to entry of credit to the end and zero. The difference between 18 and 14, or 4, is the number of additional pulses required to advance the console stepping switch to the end and zero after the dispenser credit stepper is at zero. Four is the number of pulses counted by the debit counter and corresponds to the number of credits existing on the dispenser at the start of the reset operation.

The numbers 18 and 14 are arbitrary, depending on the number of steps in the component selected and on the assumed four credits, respectively. This relation may be expressed abstractly for any component with M steps and for any assumed number of credits M minues N. Then the number of pulses required to advance the dispenser credit stepper from its position after entry of credit to the end is N. In the example, $M = 18$, $N = 14$ and $M-N = 4$.

In summary, a customer asks for and pays for the amount of fuel desired. The attendant receives the payment, identifies the dispenser, pushes the corresponding dispenser selection button, and pushes the dispenser value button for the amount of fuel paid for. The customer positions the nozzle 17 in the fuel tank of the vehicle, turns the lever 18, and opens the nozzle valve. When fuel dispensing is completed, either due to using all of the fuel paid for or a full tank or otherwise, the customer turns the lever 18 to the vertical position and replaces the nozzle 17 on the dispenser. If the customer is entitled to any change, the dispenser automatically pays out the change, and the customer drives away.

However, if before fluid flow starts, the customer changes his mind or the customer or attendant notes an error, the system may be reset by pushing the reset button, after which a different transaction may be initiated. Resetting automatically removes the credits from the selected dispenser, records these debits, and put the dispenser in the Dispenser Ready state.

The system permits handling a plurality of customers from a single attendant operated console. In the embodiment illustrated, all twelve dispensers could be in operation at the same time after the attendant has sequentially selected and entered a value for each dispenser.

The system of the present invention has several advantages over earlier systems. The system has the capability of counting the credits removed from the dispenser by the console attendant thus providing accurate accounting at the console. The system will handle purchases in excess of $10.00. A flashing Error indicator informs the attendant that; The dispenser cannot accept the quantity of credits that have been selected; The dispenser is out of change; The dispenser has lost power; or An attempted debiting is not permissible because the dispenser has commenced delivery of product.

I claim:

1. In a fluid dispensing system, the combination of:

a plurality of fluid dispensers, each of said dispensers including first register means responsive to a first set of input signals for registering a number of units of fluid to be dispensed and having a capacity of M units;

second register means for registering the number of units of fluid dispensed;

termination means for terminating dispensing when the number of units dispensed as registered in said second register means matches the number to be dispensed as registered in said first register means; and payout means for paying out change when dispensing is terminated and the number of units dispensed as registered in said second register means is less than the number of units to be dispensed as registered in said first register means; and a conrol unit connected to each of said fluid dispensers, said control unit including generation means for generating a first set of input signals corresponding to a predetermined number of units of fluid to be dispensed;

third register means for registering input signals connected thereto and having a capacity of M units;

credit counting means for counting input signals connected thereto and indicating the numberr of units of fluid to be dispensed;

debit counting means for counting input signals connected thereto and indicating the number of units of fluid not dispensed due to resetting;

selection means for selecting a dispenser and coupling said first set of input signals to said first register means of the selected dispenser and to said third register means and said cedit counting means of said control unit;

clearing means for resetting said third register means to the initial condition afer said first set of input signals have been generated by said generation means and there is a match between said predetermined number and the number registered in said third register means;

reset mens for resetting the first register of the selected dispenser prior to dispensing fluid, and including means for generating a second set of input signals corresponding to M units, with the signals for the first N units of said M units coupled to said first and third register means and with the signals for the next M minus N units coupled to said third register means and said debit counting means, where M minus N corresponds to the state of said first register means at the start of reset; and means for connecting said third register means to said reset means for terminating generation of said second set of input signals by said reset means when said third register means registers M units whereby on resetting, said debit counting means is advanced a number of units corresponding to the number of units said credit counting means was previously advanced.

2. A fluid dispensing system as defined in claim 1 wherein said generation means includes a pluse generating circuit providing voltage pulses to the seleced dispenser corresponding to the number of units to be dispensed.

3. A fluid dispensing system as defined in claim 2 wherein said generation means includes counter means for counting the pulse generating circuit output and shutting the pulse generating circuit off when a predetermined count is attained.

4. A fluid dispensing system as defined in claim 3 including:

error indicating means;

lockout means for energizing said error indicating means when the input to said first register means exceeds M units; and amount indication means for indicating the number of units actually introduced into said first register means when said error indicating means is energized.

5. A control unit for use with a plurality of fluid dispensers, each of said dispensers including first register means responsive to a first set of input signals for registering a number of units of fluid to be dispensed and having a capacity of M units;

second register means for registering the number of units of fluid dispensed;

termination means for terminating dispensing when the number of units dispensed as registered in said second register means matches the number to be dispensed as registered in said first register means; and payout means for paying out change when dispensing is terminated and the number of units dispensed as registered in said second register means is less than the number of units to be dispensed as registered in said first register means;

said control unit including in combination:

generation means for generating a first set of input signals corresponding to a predetermined number of units of fluid to be dispensed;

third register means for registering input signals connected thereto and having a capacity of M units;

credit counting means for counting input signals connected thereto and indicating the number of units of fluid to be dispensed;

debit counting means for counting input signals connected thereto and indicating the number of units of fluid not dispensed due to resetting;

selection means for selecting a dispenser and coupling said first set of input signals to said first register means of the selected dispenser and to said third register means and said credit counting means of said control unit;

clearing means for resetting said third register means to the initial condition after said first set of input signals have been generated by said generation means and there is a match between said predetermined number and the number registered in said third register means;

reset means for resetting the first register of the selected dispenser prior to dispensing fluid, and including means for generating a second set of input signals corresponding to M units, with the signal for the first N units of said M units coupled to said first and third register means and with the signals for the next M minus N units coupled to said third regster means and said debit counting means, where M minus N corresponds to the state of said first register means at the start of reset; and means for connecting said third register means to said reset means for terminating generation of said second set of input signals by said reset means when said third register means registers M units whereby on resetting, said debit counting means is advanced a number of units corresponding to the number of units said credit counting means was previously advanced.

6. A control unit as defined in claim 5 wherein said generation means includes a pulse generating circuit providing voltage pulses to the selected dispenser corresponding to the number of units to be dispensed.

7. A control unit as defined in claim 6 wherein said generation means includes counter means for counting the pulse generating circuit output and shutting the pulse generating circuit off when a predetermined count is attained.

8.. A control unit as defined in claim 7 including:

error indicating means;

lockout means for energizing said error indicating means when the input to said first register means exceeds M units; and amount indication means for indicating the number of units actually introduced into said first register means when said error indicating means is energized.

9. A control unit for use with a plurality of fluid dispensers, each of said dispensers including first register means responsive to a first set of input signals for registering a number of units of fluid to be dispensed and having a capcity of M units;

second register means for registering the number of units of fluid dispensed;

termination means for terminating dispensing when the number of units dispensed as registered in said second register means matches the number to be dispensed as registered in said first register means; and payout means for paying out change when dispensing is terminated and the number of units dispensed as registered in said second register means is less than the number of units to be dispensed as registered in said first register means;

said control unit including in combination:

a first switch means for selecting a number of sales units;

a pulse generator for generating electrical pulses as input signals;

second switch means for actuating said pulse generator to start generation of a first set of input signals;

third register means for counting input signals connected thereto and stopping generation of said first set of signals when input signals corresponding to the selected number of sales units have been generated;

credit counting means for counting input signals connected thereto and indicating the number of units of fluid to be dispensed;

debit counting means for counting input signals connected thereto and indicating the number of units of fluid not dispensed due to resetting;

selection means for selecting a dispenser and coupling said first set of input signals to said first register means of the selected dispenser and to said third register means and said credit counting means of said control unit;

clearing means for resetting said third register means to the initial condition after input signals of said first set as registered in said third register means and corresponding to sales units selected by said first switch means have been generated; and reset means for resetting the first register of the selected dispenser prior to dispensing fluid, and including means for actuating said pulse generator for generating a first group of a second set of input signals coupled to said first and third register means, third switch means for terminating said first group of signals when said first register means reaches its limit, means for actuating said pulse generator for generating a second group of said second set of signals coupled to said third register means and said debit counting means, and fourth switch means for terminating said second group of signals when said third register means reaches its limit whereby on resetting, said debit counting means is advanced a number of units corresponding to the number of units said credit counting means was previously advanced.

* * * * *

UNITED STATES PATENT AND TRADEMARK OFFICE

CERTIFICATE OF CORRECTION

PATENT NO. : 3,999,685

DATED : December 28, 1976

INVENTOR(S) : Robert C. Greenwood

It is certified that error appears in the above-identified patent and that said Letters Patent are hereby corrected as shown below:

Col. 3, line 52, insert --and-- before "includes"

Col. 4, line 3, "bby" should be --by--

Col. 5, line 8, "if" should be --in--

Col. 6, line 5, delete "energy"

Col 6, line 6, delete "that"

Col. 6, line 13, "enrgy" should be --energy--

Col. 6, line 16, "thAt" should be --that--

Col. 6, line 51, "VL" should be --V1--

Col. 7, line 53, "RER" should be --RFR--

Col. 8, line 47, "tio" should be --to--

Col. 9, line 52, "can" should be --cam--

Col. 9, line 59, "substract" should be -- Substract --

Col. 11, line 25, "cricuitry" should be - circuitry--

UNITED STATES PATENT AND TRADEMARK OFFICE

CERTIFICATE OF CORRECTION

PATENT NO. : 3,999,685

DATED : December 28, 1976

INVENTOR(S) : Robert C Greenwood

It is certified that error appears in the above-identified patent and that said Letters Patent are hereby corrected as shown below:

Col. 14, line 1, "DLo7" should be --DLO7--

Col. 17, line 55, "minues" should be --minus--

Col. 18, line 25, insert a. before "The"

Col. 18, line 27, insert b. before the first occurrence of "The"

Col. 18, line 27, insert c. before the second occurrence of "The"

Col. 18, line 28, insert d. before "or"

Col 19 line 2, "afer" should be --after--

Col. 19, line 7, "mens" should be --means--

Col. 19, line 26, "pluse" should be --pulse --

Col. 20, line 58, "capcity" should be -- capacity --

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*